US010351375B2

(12) United States Patent
Tsuzuki

(10) Patent No.: US 10,351,375 B2
(45) Date of Patent: Jul. 16, 2019

(54) SHEET PROCESSING APPARATUS AND CONTROL METHOD

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Seiji Tsuzuki, Saitama (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/847,109

(22) Filed: Dec. 19, 2017

(65) Prior Publication Data

US 2019/0055099 A1 Feb. 21, 2019

(30) Foreign Application Priority Data

Aug. 21, 2017 (JP) ..... 2017-158627

(51) Int. Cl.
*B65H 7/18* (2006.01)
*B65H 1/04* (2006.01)
(Continued)

(52) U.S. Cl.
CPC ..... *B65H 7/18* (2013.01); *B65H 1/04* (2013.01); *B65H 3/06* (2013.01); *B65H 3/0669* (2013.01); *B65H 3/5215* (2013.01); *B65H 5/062* (2013.01); *B65H 7/12* (2013.01); *B65H 37/04* (2013.01); *G03G 15/5012* (2013.01); *G03G 15/6511* (2013.01); *B65H 2511/414* (2013.01); *B65H 2511/515* (2013.01); *B65H 2513/412* (2013.01); *B65H 2513/53* (2013.01); *B65H 2601/11* (2013.01); *B65H 2701/1829* (2013.01); *B65H 2801/06* (2013.01); *G03G 15/703* (2013.01); *G03G 2215/00548* (2013.01)

(58) Field of Classification Search
CPC ..... B65H 7/18; B65H 3/0623; B65H 3/5246; B65H 3/60; B65H 37/00; B65H 5/06; G03G 15/5012; G03G 15/6511; G03G 15/703; G03G 2221/1675; G03G 2215/00548
See application file for complete search history.

(56) References Cited

U.S. PATENT DOCUMENTS

2010/0067071 A1 3/2010 Rozenfeld et al.
2017/0174457 A1 6/2017 Hirota et al.
2017/0355539 A1* 12/2017 Yoshiwara ..... B65H 3/06

FOREIGN PATENT DOCUMENTS

JP 2000-094363 A 4/2000
JP 2013-119466 A 6/2013

OTHER PUBLICATIONS

Extended European Search Report dated Jul. 10, 2018,in corresponding European application No. 18 15 9430.0,7 pages.

* cited by examiner

*Primary Examiner* — David H Bollinger
(74) *Attorney, Agent, or Firm* — Foley & Lardner LLP

(57) ABSTRACT

A sheet processing apparatus is described. The sheet processing apparatus includes a housing section, a conveyance mechanism and a controller. The housing section accommodates a sheet. The conveyance mechanism conveys the sheet accommodated in the housing section to a predetermined position at the downstream side in a sheet conveyance direction. The controller controls the conveyance mechanism to remove a needle-free binding section of a sheet bundle if a conveyance jam of the sheet occurs.

6 Claims, 10 Drawing Sheets

(51) Int. Cl.

| | |
|---|---|
| ***B65H 37/04*** | (2006.01) |
| ***B65H 3/06*** | (2006.01) |
| ***B65H 3/52*** | (2006.01) |
| ***B65H 5/06*** | (2006.01) |
| ***B65H 7/12*** | (2006.01) |
| ***G03G 15/00*** | (2006.01) |

SHEET PROCESSING APPARATUS AND CONTROL METHOD

CROSS-REFERENCE TO RELATED APPLICATIONS

This application is based upon and claims the benefit of priority from Japanese Patent Application No. 2017-158627, filed Aug. 21, 2017, the entire contents of which are incorporated herein by reference.

FIELD

Embodiments described herein relate generally to a sheet processing apparatus and a control method.

BACKGROUND

There is a sheet processing apparatus having a function of conveying a sheet such as a paper. In the sheet processing apparatus, if a sheet bundle is set in a cassette or a document tray without removing a binding part of the sheet bundle, the sheet bundle is blocked on a conveyance route and a conveyance jam occurs. There is a problem that the sheet processing apparatus cannot normally convey the sheet if the conveyance jam occurs.

DETAILED DESCRIPTION

In accordance with an embodiment, a sheet processing apparatus comprises a housing section, a conveyance mechanism and a controller. The housing section accommodates a sheet. The conveyance mechanism conveys the sheet accommodated in the housing section to a predetermined position at the downstream side in a sheet conveyance direction. The controller controls the conveyance mechanism to remove a needle-free binding section of a sheet bundle if a conveyance jam of the sheet occurs.

Hereinafter, a sheet processing apparatus and a control method of an embodiment are described with reference to the accompanying drawings.

First Embodiment

Figure 1:
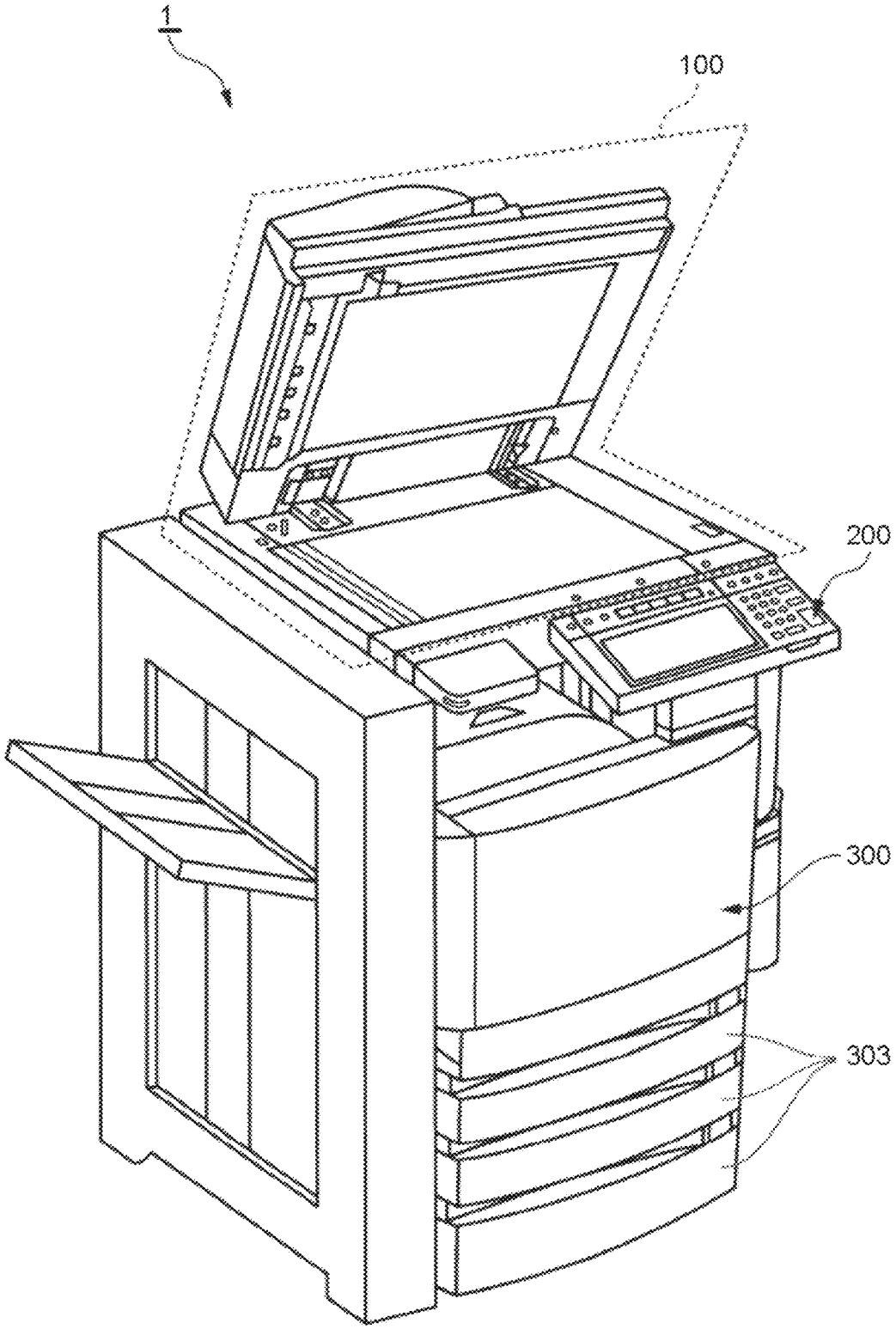
FIG. 1 is an external view exemplifying the structure of a sheet processing apparatus according to a first embodiment.
Figure 2:
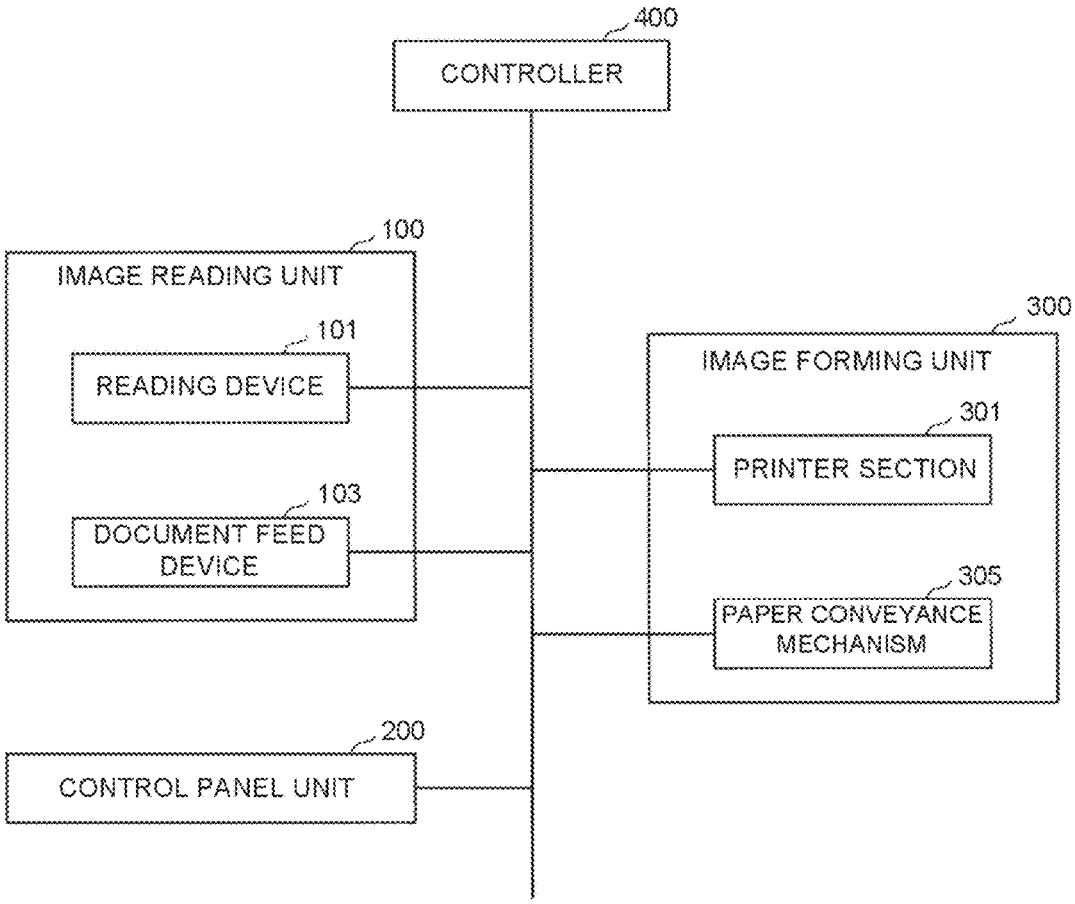
FIG. 2 is a block diagram illustrating the system structure of the sheet processing apparatus according to the first embodiment.

FIG. 1 is an external view exemplifying the constitution of a sheet processing apparatus according to the first embodiment. FIG. 2 is a block diagram illustrating the system structure of the sheet processing apparatus according to the first embodiment.

As shown in FIG. 1 and FIG. 2, a sheet processing apparatus 1 of the present embodiment is, for example, an MFP (Multi Function Peripheral). The sheet processing apparatus 1 includes an image reading unit 100, a control panel unit 200, an image forming unit. 300, and a controller 400.

The image reading unit 100 reads an image on an original document. The image reading unit 100 outputs data indicating a read image (hereinafter, referred to as a "read image") to the image forming unit 300, for example.

The control panel unit 200 functions as a user interface for receiving an operation input from a user. For example, the control panel unit 200 includes a touch panel formed by an operation section and a display section integrally. The control panel unit 200 is connected to the controller 400 in a communicable manner. The operation section of the control panel unit 200 receives an instruction of the operation of the sheet processing apparatus 1 based on the operation by the user. The display section of the control panel unit 200 displays information to the user. For example, the information displayed on the display section of the control panel unit 200 is information output by the controller 400.

The image forming unit 300 forms the read image on which an image processing is executed on a sheet for printing accommodated in a paper feed cassette 303. The sheet for printing is referred to as a paper below. The image forming unit 300 may print an image input from an external device via a network on the paper. The image forming unit 300 is not limited to the image forming apparatus for fixing a toner image but may be an inkjet type image forming apparatus.

The controller 400 is a computer that controls the image reading unit 100, the control panel unit 200 and the image forming unit 300. The controller 400 may be a compute separate from the computer controlling each unit. For example, the controller 400 is a computer dedicated to controlling the sheet processing apparatus 1.

Figure 3:
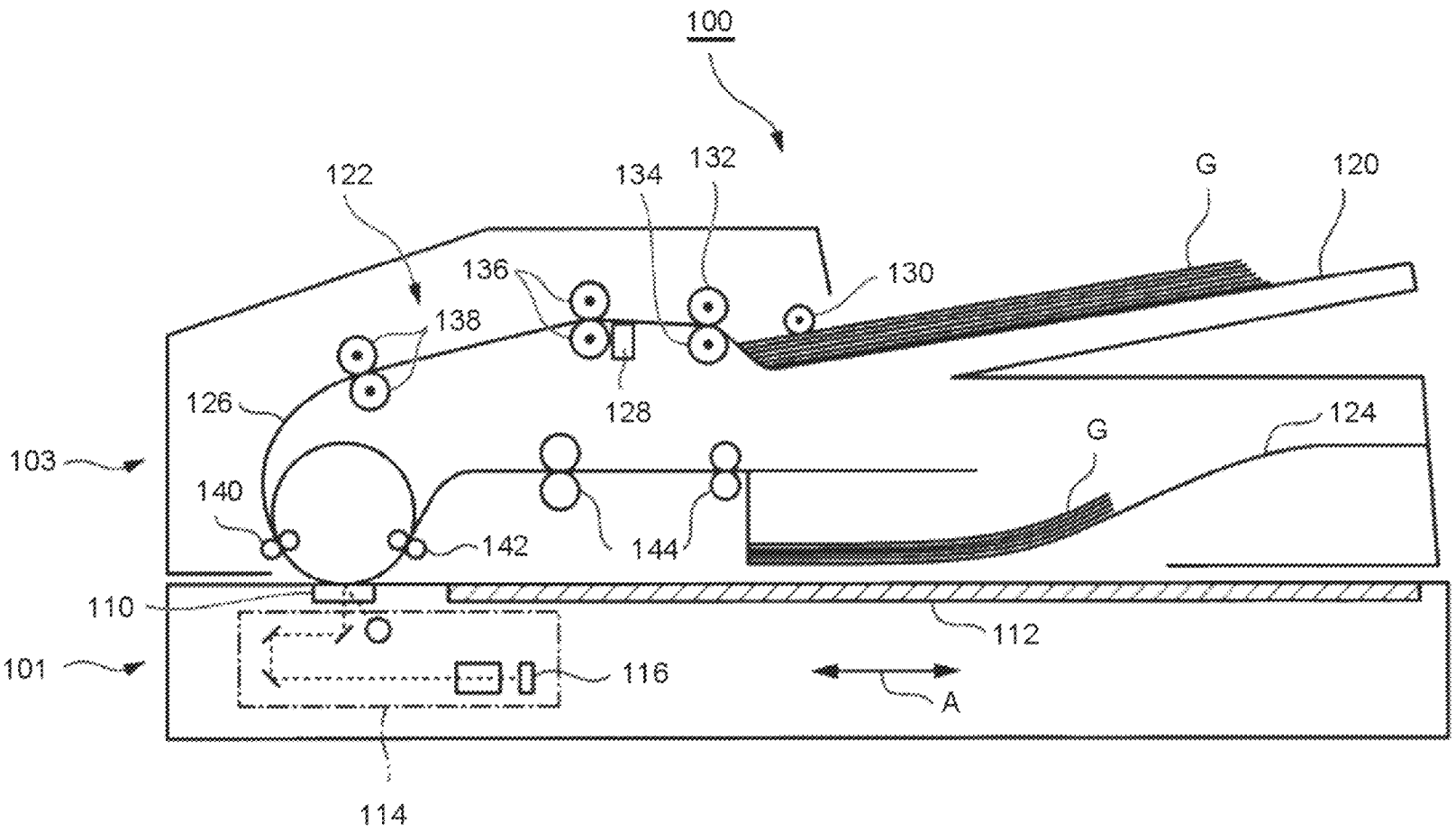
FIG. 3 is a schematically cross-sectional view exemplifying the structure of an image reading unit according to the first embodiment.

Next, with reference to FIG. 3, a detailed structure of the image reading unit 100 of the first embodiment is described.

FIG. 3 is a schematically cross-sectional view exemplifying the structure of the image reading unit according to the first embodiment.

As shown in FIG. 3, the image reading unit 100 has a reading device 101 and a document feed device 103.

The reading device 101 includes a slit glass 110, a platen lass 112, an optical mechanism 114 and an image reading sensor 116.

The slit glass 110 is a transmissive member formed spindly in a main scanning direction. The slit glass 110 is provided at a portion through which an original document G conveyed by the document feed device 103 passes.

The platen glass 112 is a transmissive member formed to have a width in the main scanning direction and a sub-scanning direction. The platen glass 112 is provided at a portion where the original document G is placed. The platen glass 112 constitutes a document placing table.

The optical mechanism 114 irradiates the original document G moving on the slit glass 110 with light and propagates reflected light from the original document G to the image reading sensor 116. The optical mechanism 114 moves along the platen glass 112 in an arrow A direction by a driving module (not shown). The optical mechanism 114 irradiates the original document G placed on the platen glass 112 with the light and propagates the reflected light from the original document G to the image reading sensor 116.

The image reading sensor 116 performs photoelectric conversion to convert the reflected light propagated from the optical mechanism 114 into an electrical signal and outputs a read signal. The image reading sensor 116 is, for example, a CCD (Charge Coupled Device). In the slit glass 110, the image reading sensor 116 reads an image of the surface which is the first surface of the original document G moving on the glass surface. The image reading sensor 116 reads the image on the first surface of the original document G placed on the platen glass 112. The image reading sensor 116 outputs data indicating the read image to the image forming unit 300.

The document feed device 103 includes a document tray 120 (housing section), a document conveyance mechanism 122 (conveyance mechanism), and a paper discharge tray 124 (predetermined position).

The document tray 120 is a tray on which the original document G conveyed by the document feed device 103 is placed (accommodated). On the document tray 120, the original document G, which is a reading object by the reading device 101, is placed. The document tray 120 is capable of placing a plurality of the original documents G in an overlapped manner.

The document conveyance mechanism 122 conveys the original document G placed on the document tray 120 to the reading device 101 at the downstream side in the conveyance direction. The document conveyance mechanism 122 conveys the original document G, the image of which is read by the reading device 101, to the paper discharge tray 124. The document conveyance mechanism 122 is controlled by the controller 400.

The paper discharge tray 124 is a tray that receives the original document G discharged by the document conveyance mechanism 122. After the image is read by the reading device 101, the original document G conveyed by the document conveyance mechanism 122 is discharged to the paper discharge tray 124.

Here, the document conveyance mechanism 122 is described in detail.

In the document conveyance mechanism 122, a document conveyance path 126 through which the original document G is conveyed is formed. The document conveyance path 126 is a path from the document tray 120 to the paper discharge tray 124 through the reading device 101. The original document G placed on the document tray 120 is conveyed through the document conveyance path 126 to move from the document tray 120 to the paper discharge tray 124 through the reading device 101.

In the document conveyance mechanism 122, a plurality of rollers for sending the original document G to the document conveyance path 126 and a document sensor 128 for detecting the original document G moving along the document conveyance path 126 are provided.

The plurality of rollers includes a pickup roller 130, a paper feed roller 132, a separation roller 134, a resist roller 136, an intermediate roller 138, a pre-reading roller 140, a post-reading roller 142, and a paper discharge roller 144. The plurality of rollers is driving rollers connected to a driving section such as a motor or the like.

The pickup roller 130 feeds the original documents G placed on the document tray 120 one by one. A rotation axis of the pickup roller 130 is in a direction which is along a plane of the original document G and orthogonal to the conveyance direction of the original document G (hereinafter, referred to as a document width direction. The pickup roller 130 is arranged to be capable of abutting against the upper surface of the original document G at the top of the plurality of the original documents G placed on the document tray 120. The pickup roller 130 abuts against an end at the downstream side in the conveyance direction of the upper surface of the uppermost original document G placed on the document tray 120. The pickup roller 130 forward rotates while abutting against the upper surface of the uppermost original document G placed on the document tray 120 to send the original document G to the document conveyance path 126. The contact position of the pickup roller 130 with respect to the original document G in the document width direction is not particularly limited. For example, it is desirable that the pickup roller 130 is arranged to be capable of contacting with a corner of the original document G. The pickup roller 130 may be arranged to be capable of changing the position in the document width direction.

The paper feed roller 132 conveys the original document G fed by the pickup roller 130 from the document tray 120 to the downstream side in the conveyance direction. The paper feed roller 132 conveys the original document G to the downstream side in the conveyance direction by forward rotation.

The separation roller 134 is arranged at a position opposite to the paper feed roller 132 via the document conveyance path 126. The separation roller 134 forms a nip for sandwiching the original document G. The separation roller 134 is driven to rotate in an arbitrary direction by a frictional force with the paper feed roller 132 or the original document G if not driven by the driving section if the original document G is not interposed between the paper feed roller 132 and the separation roller 134, the separation roller 134 forward rotates through driving by the paper feed roller 132. If one original document G is interposed between the paper feed roller 132 and the separation roller 134, a driving force of the paper feed roller 132 reaches the separation roller 134 via the original document G. As a result, the separation roller 134 forward rotates through driving by the original document G if a plurality of the original documents G is interposed between the paper feed roller 132 and the separation roller 134, the driving force of the paper feed roller 132 does not reach the separation roller 134. As a result, the separation roller 134 stops rotating. Thus, the paper feed roller 132 and the separation roller 134 can convey only one original document G to the downstream side in the conveyance direction even if a plurality of the original documents G is overlapped.

A pair of resist rollers 136 is arranged and faces each other across the document conveyance path 126. At a mutual abutment position, the resist roller 136 aligns a tip position of the original document G sent from the paper feed roller 132. The resist roller 136 conveys the original document G with the tip position thereof aligned to the downstream side in the conveyance direction.

The intermediate roller 138 conveys the original document G sent from the resist roller 136 to the downstream side in the conveyance direction.

The pre-reading roller 140 conveys the original document G sent from the intermediate roller 138 towards the reading device 101 to the downstream side in the conveyance direction.

The post-reading roller 142 conveys the original document G, which is sent out from the pre-reading roller 140 and of which the image is read by the reading device 101, to the downstream side in the conveyance direction.

The paper discharge roller 144 conveys the original document G sent out from the post-reading roller 142 to the downstream side in the conveyance direction and discharges it to the paper discharge tray 124.

The document sensor 128 detects whether or not the original document G is normally conveyed on the document conveyance path 126. The document sensor 128 is arranged at a position at the downstream side in the conveyance direction of the paper feed roller 132 in the document conveyance path 126. The document sensor 128 detects whether or not the original document G is normally sent out from the paper feed roller 132 between the paper feed roller 132 and the resist roller 136. The document sensor 128 may contact the original document G moving in the document conveyance path 126. The document sensor 128 may be an optical sensor that detects the presence or absence of the original document G moving in the document conveyance path 126 with light. The document sensor 128 sends the detection result to the controller 400.

Figure 4:
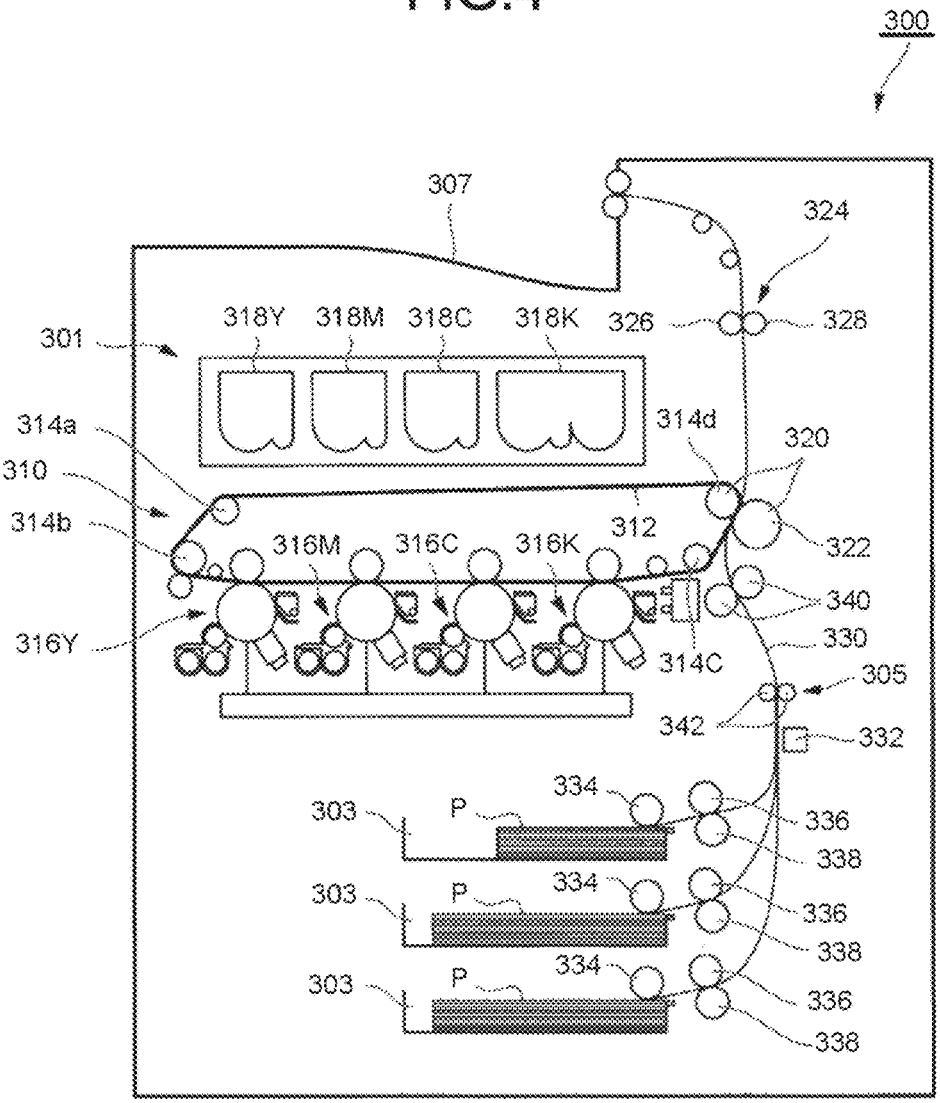
FIG. 4 is a schematically cross-sectional view exemplifying the structure of an image forming unit according to the first embodiment.

Next, with reference to FIG. 4, a detailed structure of the image forming unit 300 according to the first embodiment is described.

FIG. 4 is a schematically cross-sectional view exemplifying the structure of the image forming unit according to the first embodiment.

As shown in FIG. 4, the image forming unit 300 includes a printer section 301, a paper feed cassette 303 (housing section), a paper conveyance mechanism 305 (conveyance mechanism), and a paper discharge section 307 (predetermined position). In the present embodiment, the printer section 301 of an intermediate transfer system is described as an example. However, the composition of the present embodiment is also applicable to the sheet processing apparatus having a printer section of a direct transfer system. The printer section 301 has an intermediate transfer section 310, a plurality of toner cartridges 318Y, 318M, 318C and 318K, a secondary transfer section 320, and a fixing section 324.

The intermediate transfer section 310 has an intermediate transfer belt 312, a plurality of belt rollers 314*a*, 314*b*, 314*c* and 314*d* and a plurality of image forming sections 316Y, 316M, 316C and 316K.

The intermediate transfer belt 312 is formed in an endless shape. The plurality of belt rollers 314*a*, 314*b*, 314*c* and 314*d* support the intermediate transfer belt 312. As a result, the intermediate transfer belt 312 can run endlessly.

The plurality of image forming sections 316Y, 316M, 316; and 316K is yellow image forming section 316Y, magenta image forming section 316M, cyan image forming section 316C, and black image forming section 316K. Each of the image forming sections 316Y, 316M, 316C and 316K includes a photoconductive drum, an electrostatic charger, an exposure unit, a developing device, and a transfer roller. Each image forming section 316Y, 316M, 316; and 316K transfers (primarily transfers) a toner image formed on the surface of the photoconductive drum onto the intermediate transfer belt 312. The structures of the image forming sections 316Y, 316M, 316C and 316K are substantially the same as each other except that the colors of a recording agent (toner) therein are different.

The toner cartridges 318Y, 318M, 318C and 318K are disposed above the intermediate transfer section 310. The toner cartridges 318Y, 318M, 3180 and 318K supply the recording agent to the developing devices of the respective image forming sections 316Y, 316M, 316C and 316K. The toner cartridges 318Y, 318M, 3180 and 318K accommodate yellow recording agent, magenta recording agent, cyan recording agent and black recording agent, respectively.

The secondary transfer section 320 includes a transfer roller 322. The transfer roller 322 contacts with the outer surface of the intermediate transfer belt 312. One belt roller 314*d* supporting the intermediate transfer belt 312 is included in components of the secondary transfer section 320. The belt roller 314*d* faces the transfer roller 322 with the intermediate transfer belt 312 therebetween. The paper P is sandwiched between the transfer roller 322 and the belt roller 314*d* together with the intermediate transfer belt 312. As a result, the recording agent on the intermediate transfer belt 312 is transferred (secondarily transferred) onto the surface of the paper P.

The fixing section 324 has a heat roller 326 and a pressure roller 328. The heat roller 326 is controlled to a fixing temperature (printing temperature) suitable for fixing the recording agent. The pressure roller 328 faces the paper P from a side opposite to the heat roller 326. The paper P onto which the recording agent is transferred is sandwiched between the heat roller 326 and the pressure roller 328. As a result, the paper P is heated and pressurized between the heat roller 326 and the pressure roller 328. The recording agent transferred onto the paper P is fixed on the paper P.

The paper feed cassette 303 is capable of accommodating the paper P on which images are printed in the printer section 301. The paper feed cassette 303 accommodates a plurality of the papers P in an overlapped manner. A plurality of the paper feed cassettes 303 is arranged in response to a size or the like of the accommodated paper P.

The paper conveyance mechanism 305 conveys the paper P accommodated in the paper feed cassette 303 to the paper discharge section 307 of the downstream side in the conveyance direction. In the paper conveyance mechanism 305, a paper conveyance path 330 through which the paper P is conveyed is formed. The paper conveyance path 330 is a path from the paper feed cassette 303 to the paper discharge section 307 through the secondary transfer section 320 and the fixing section 324. The paper P accommodated in the paper feed cassette. 303 is conveyed through the paper conveyance path 330 and moves from the paper feed cassette 303 to the paper discharge section 307 through the secondary transfer section 320 and the fixing section 324.

The paper conveyance mechanism 305 includes a plurality of rollers for sending out the paper P to the paper conveyance path 330 and a paper sensor 332 for detecting the paper P moving in the paper conveyance path 330.

The plurality of rollers includes a pickup roller 334, a paper feed roller 336, a separation roller 338, a resist roller 340, and a conveyance roller 342. The plurality of rollers is driving rollers connected to the driving section such as a motor or the like.

The pickup roller 334 is arranged corresponding to each paper feed cassette 303. The pickup roller 334 feeds the papers P accommodated in the paper feed cassette 303 one by one. The rotation axis of the pickup roller 334 is in a direction which is along a plane of the paper P and orthogonal to the conveyance direction of the paper P (hereinafter, referred to as a paper width direction. The pickup roller 334 is arranged to be capable of abutting against the upper surface of the paper P at the top of the plurality of the papers P accommodated in the paper feed cassette 303. The pickup roller 334 abuts against an end at the downstream side in the conveyance direction of the upper surface of the uppermost paper P accommodated in the paper feed cassette 303. The pickup roller 334 forward rotates while abutting against the upper surface of the uppermost paper P accommodated in the paper feed cassette 303 to send the paper P to the paper conveyance path 330. The contact position of the pickup roller 334 with the paper P in the paper width direction is not particularly limited. For example, it is desirable that the pickup roller 334 is arranged to be capable of contacting with a corner of the paper P. The pickup roller 334 may be arranged to be capable of changing the position in the paper width direction.

The paper feed roller 336 is arranged corresponding to each pickup roller 334. The paper feed roller 336 conveys the paper P fed by the pickup roller 334 from the paper feed cassette 303 to the downstream side in the conveyance direction. The paper feed roller 336 conveys the paper P to the downstream side in the conveyance direction by forward rotation.

The separation roller 338 is arranged at a position opposite to the paper feed roller 336 via the paper conveyance path 330. The separation roller 338 forms a nip for sandwiching the paper P. The separation roller 338 is driven to rotate in an arbitrary direction by a frictional force with the paper feed roller 336 or the paper P if not driven by the driving section. If the paper P is not interposed between the paper feed roller 336 and the separation roller 338, the separation roller 338 forward rotates through driving by the paper feed roller 336. If one paper P is interposed between the paper feed roller 336 and the separation roller 338, a driving force of the paper feed roller 336 reaches the separation roller 338 via the paper P. As a result, the separation roller 338 forward rotates through driving by the paper P. If a plurality of the papers P is interposed between the paper feed roller 336 and the separation roller 338, the driving force of the paper feed roller 336 does not reach the separation roller 338. As a result, the separation roller 338 stops rotating. Thus, the paper feed roller 336 and the separation roller 338 can convey only one paper P to the downstream side in the conveyance direction even if a plurality of the papers P is overlapped.

A pair of resist rollers 340 is arranged and faces each other across the paper conveyance path 330. At a mutual abutment position, the resist roller 340 aligns a tip position of the paper P sent from the paper feed roller 336. The resist roller 340 conveys the paper P with the tip position thereof aligned to the downstream side in the conveyance direction.

The conveyance roller 342 is appropriately arranged on the paper conveyance path 330. The conveyance roller 342 sends out the paper p sent from the paper feed roller 336 to the resist roller 340.

The paper sensor 332 detects whether or not the paper P is normally conveyed on the paper conveyance path 330. The paper sensor 332 is arranged at a position at the downstream side in the conveyance direction of the paper feed roller 336 in the paper conveyance path 330. The paper sensor 332 detects whether or not the paper P is normally sent out from the paper feed roller 336 at the downstream side in the conveyance direction of the paper feed roller 336. The paper sensor 332 may contact the paper P moving in the paper conveyance path 330. The paper sensor 332 may be an optical sensor that detects the presence or absence of the paper P moving in the paper conveyance path 330 with light. The paper sensor 332 sends the detection result to the controller 400.

Next, the operation of the sheet processing apparatus 1 of the present embodiment is described. In the following description, the original document G and the paper P may be collectively referred to as a sheet. The document conveyance mechanism 122 and the paper conveyance mechanism 305 may be collectively referred to as conveyance mechanisms 122 and 305. The document conveyance path 126 and the paper conveyance path 330 may be collectively referred to as conveyance paths 126 and 330.

First, with reference to FIG. 3, a conveyance operation of the original document G in the image reading unit 100 is described. The data indicating the read image is read by reading the original document G in the image reading unit 100. In this case, the user places the original document G on a document placing table (platen glass 112) of the reading device 101 or the document tray 120 of the document feed device 103. Thereafter, a user inputs an operation for starting document reading through the control panel unit 200 (refer to FIG. 1). If the original document G is placed on the document tray 120, the document conveyance mechanism 122 conveys the original documents G one by one from the document tray 120 to the reading device 101. The document conveyance mechanism 122 conveys the original document G passing through the reading device 101 to the paper discharge tray 124. The controller 400 stores the data indicating the read image read in the reading device 101.

Subsequently, with reference to FIG. 4, the conveyance operation of the paper P in the image forming unit 300 is described. If the printing on the paper P in the image forming unit 300 is carried out, the paper conveyance mechanism 305 conveys the papers P one by one from the paper feed cassette 303 to the secondary transfer section 320. The printer section 301 transfers the recording agent onto the paper P in the secondary transfer section 320 and further fixes the recording agent on the paper P in the fixing section 324. The paper conveyance mechanism 305 conveys the paper P passing through the secondary transfer section 320 and the fixing section 324 to the paper discharge section 307.

Here, if the sheet bundle comprised of a plurality of bound sheets is accommodated in the document tray 120 or the paper feed cassette 303, the conveyance mechanisms 122 and 305 cannot convey the sheets one by one. Specifically, if the pickup rollers 130 and 334 send out the uppermost sheet of the sheet bundle to the conveyance paths 126 and 330, other sheets of the sheet bundle are also dragged to be sent to the conveyance paths 126 and 330. If the sheet bundle sent out from the pickup rollers 130 and 334 is conveyed to the paper feed rollers 132 and 336, the separation rollers 134 and 338 cannot separate the second and subsequent sheets from the first sheet. As a result, the conveyance jam (paper jam) occurs between the paper feed rollers 132 and 336 and the separation rollers 134 and 338.

In the sheet processing apparatus 1 of the present embodiment, if the conveyance jam occurs, a processing of removing a needle-free binding section 10 of the sheet bundle is executed. The needle-free binding section 10 is a joint portion of a plurality of sheets which is provided at the time of binding a plurality of sheets without using a needle (staple). As a method of binding a plurality of sheets without using the needle, for example, there is a method of binding a plurality of sheets by crimping, a method of binding a plurality of sheets by pasting them with adhesive a method of binding a plurality of sheets by affixing a tape to an edge, or the like. In a case of binding a plurality of sheets by crimping, the needle-free binding section 10 is a crimping section 11 (refer to FIG. 5). In a case of binding a plurality of sheets by sticking them with the adhesive, the needle-free binding section 10 is a bonded place between sheets. In a case of binding a plurality of sheets by affixing tape to the edge, the needle-free binding section 10 is a tape affixed to the sheet bundle.

Here, the needle-free binding section 10 including the crimping section 11 is described in detail.

Figure 5:
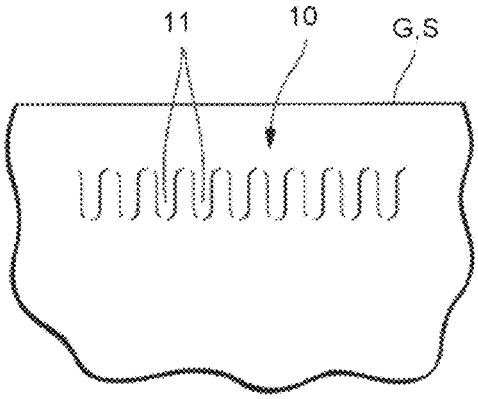
FIG. 5 is a plan view illustrating an example of a needle-free binding section.

FIG. 5 is a plan view illustrating an example of the needle-free binding section.

As shown in FIG. 5, the crimping section 11 has a concavo-convex shape formed collectively on a plurality of sheets. The crimping section 11 is formed by performing crimping so that a plurality of sheets is bundled together. The plurality of sheets is fitted to each other in the crimping section 11. A frictional force in an overlapping direction is generated between the plurality of sheets in the crimping section 11. As a result, a plurality of sheets is bound. A plurality of the crimping sections 11 is provided in the needle-free binding section 10, and is arranged, for example, in a line along an arbitrary direction. The plurality of the crimping sections 11 may be arranged along the edge of the sheet as shown in FIG. 5, or may be provided at corners of the sheet and obliquely with respect to the edge of the sheet.

The processing flow of the controller 400 during sheet conveyance is described in detail below. In the following description, the sheet conveyance operation in the image forming unit 300 is described as an example, but the sheet conveyance operation in the image reading unit 100 is also the same.

Figure 6:
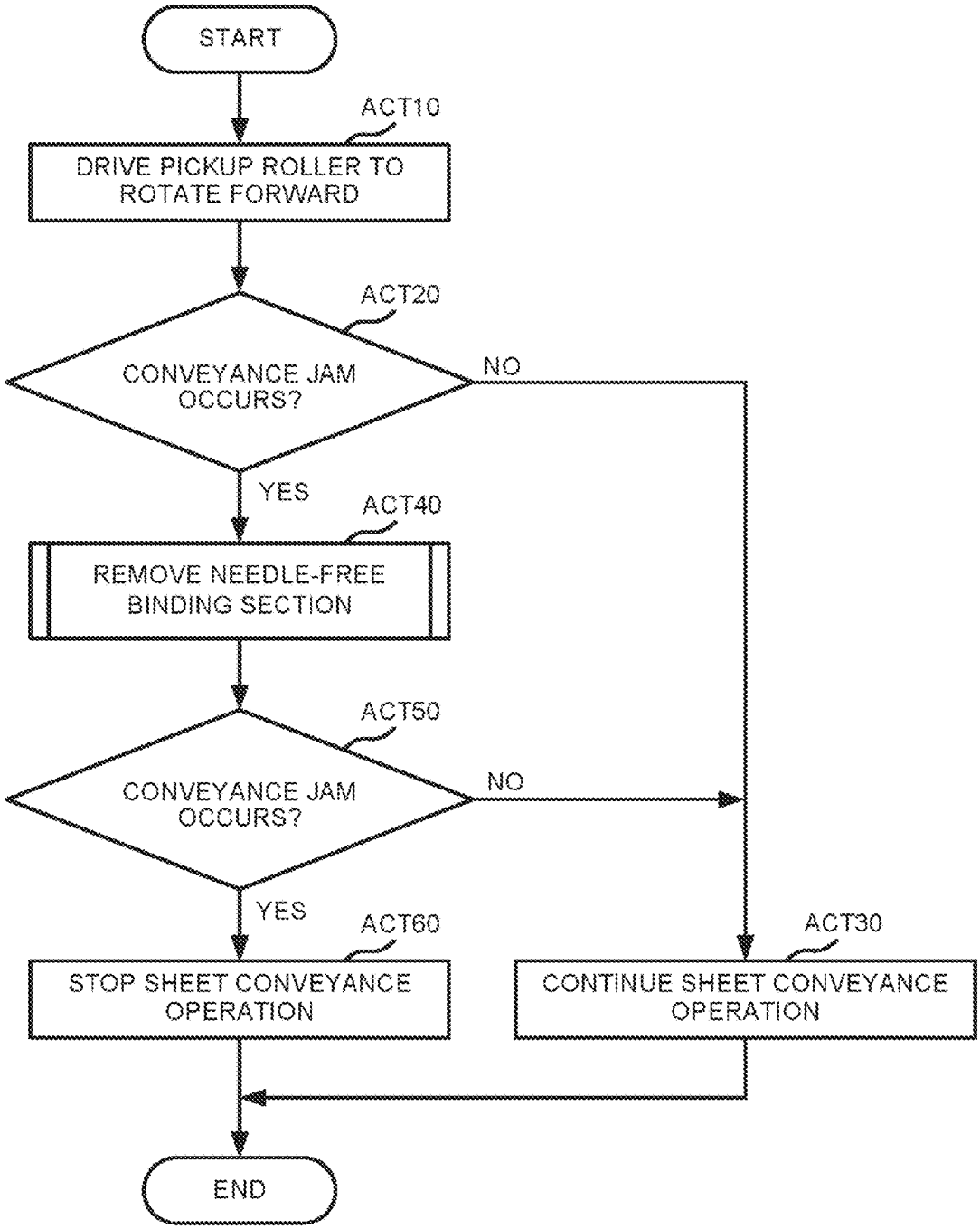
FIG. 6 is a flowchart exemplifying the operation of the sheet processing apparatus according to the first embodiment.

FIG. 6 is a flowchart exemplifying the operation of the sheet processing apparatus according to the first embodiment.

The sheet processing apparatus 1 conveys the sheet by executing a processing according to the flow shown in FIG. 6.

In the present embodiment, the controller 400 conveys the paper P from the paper feed cassette 303 to the paper discharge section 307 if the sheet is conveyed in the image forming unit 300 (ACT 10). Specifically, the controller 400 drives the pickup roller 334 in a forward direction while abutting against the upper surface of the uppermost paper P accommodated in the paper feed cassette 303.

Subsequently, the controller 400 determines whether or not the conveyance jam of the paper P occurs in the paper feed cassette 303 or the paper conveyance path 330 (ACT 20). Specifically, based on a detection result of the paper sensor 332, the controller 400 determines whether or not the paper P is sent out from the paper feed roller 336 within a predetermined period of time from the start of conveyance of the paper P. If the paper P is not sent out from the paper feed roller 336, the conveyance jam of the paper P occurs in the paper feed roller 336. If the conveyance jam does not occur (No in ACT 20), the controller 400 continues sheet conveyance operation (ACT 30). Thereafter, the sheet processing apparatus 1 ends the sheet conveyance operation.

If the conveyance jam occurs (Yes in ACT 20), the controller 400 executes a processing of removing the needle-free binding section 10 of the sheet bundle to the paper P (ACT 40). The processing of removing the needle-free binding section 10 of the sheet bundle is described later.

Thereafter, the controller 400 again determines whether or not the conveyance jam of the paper P occurs in the paper feed cassette 303 or the paper conveyance path 330 (ACT 50). The processing in ACT 50 is the same as that in ACT 20. If the conveyance jam does not occur (No in ACT 50), the controller 400 continues the sheet conveyance operation (ACT 30). If the conveyance jam occurs (Yes in ACT 50), since the needle-free binding section 10 of the sheet bundle is not removed in the processing in ACT 40, the controller 400 executes stop processing of the sheet conveyance operation (ACT 60). Specifically, the controller 400 stops driving the paper conveyance mechanism 305. The controller 400 may display, for example, that the conveyance jam occurs on the display section of the control panel unit 200 in the processing in ACT 60.

Next, the processing of removing the needle-free binding section 10 of the sheet bundle in the first embodiment is described in detail.

In the present embodiment, if the conveyance jam of the paper P occurs in the paper feed cassette 303 or the paper conveyance path 330, the controller 400 performs control so that the pickup roller 334 is alternately rotated in both forward and reverse directions. Specifically, the controller 400 proceeds the processing according to the following flow.

Figure 7:
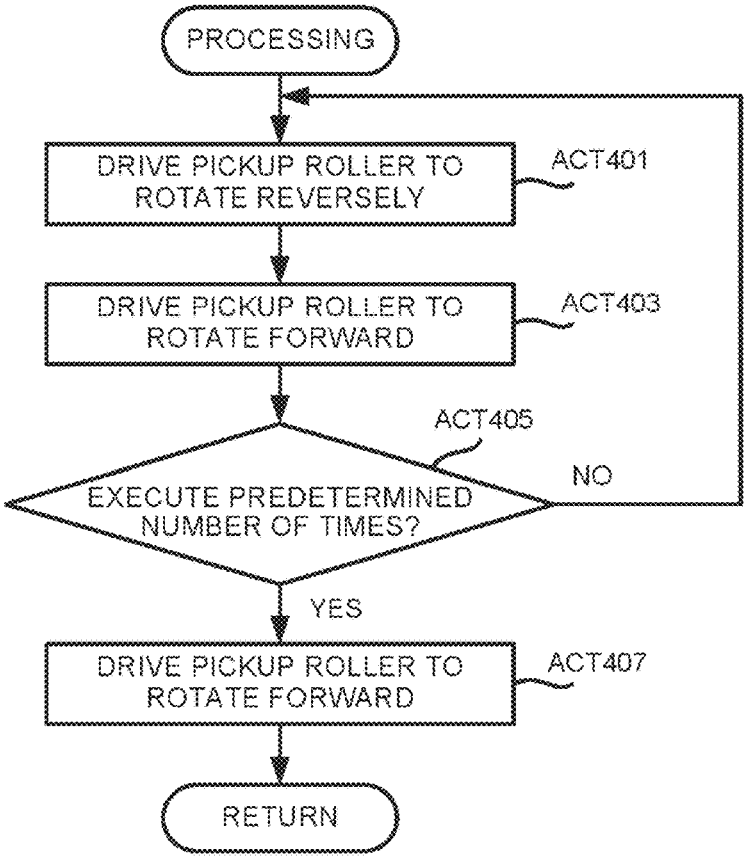
FIG. 7 is a flowchart illustrating the flow of a processing of removing a needle-free binding section in the sheet processing apparatus according to the first embodiment.

FIG. 7 is a flowchart illustrating the flow of the processing of removing the needle-free binding section in the sheet processing apparatus according to the first embodiment.

As shown in FIG. 7, the controller 400 drives the pickup roller 334 to rotate in a reverse direction to move the paper P towards the upstream side in the conveyance direction (ACT 401). Subsequently, the controller 400 drives the pickup roller 334 to rotate in the forward direction to move the paper P toward the downstream side in the conveyance direction (ACT 403). Thereafter, the controller 400 determines whether or not the pickup roller 334 is driven to rotate in each of the reverse direction and the forward direction a predetermined number of times (ACT 405). In other words, in ACT 405, the controller 400 determines whether or not the processing in ACT 401 and the processing in ACT 403 are both executed a predetermined number of times. If the rotation driving in the reverse direction and the rotation driving in the forward direction of the pickup roller 334 are not executed a predetermined number of times (No in ACT 405), the controller 400 again executes processing in ACT 401. If the rotation driving in the reverse direction and the rotation driving in the forward direction of the pickup roller 334 are both executed a predetermined number of times (Yes in ACT 405), the controller 400 drives the pickup roller 334 to rotate in the forward direction to resume the sheet conveyance (ACT 407) and proceeds to the processing in ACT 50. Conveyance distances of the paper P in the processing in ACT 403 and ACT 405 can be arbitrarily set.

Figure 8:
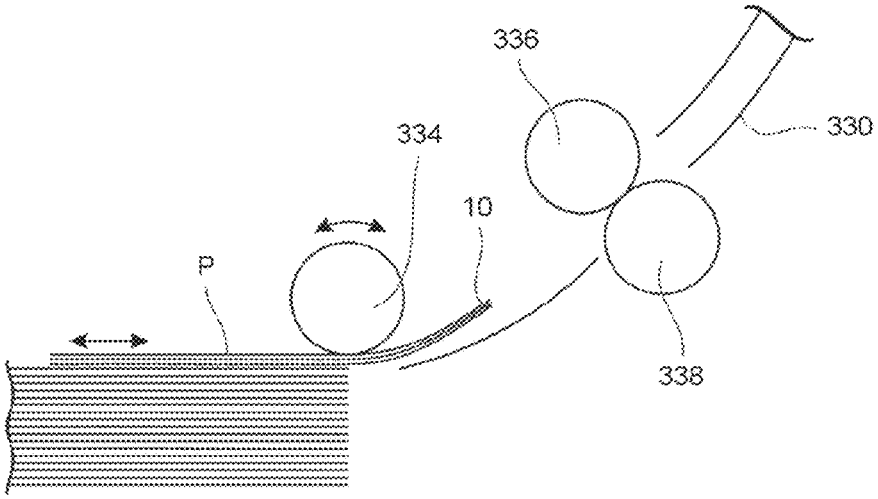
FIG. 8 is a schematic diagram illustrating the operation of removing the needle-free binding section in the sheet processing apparatus according to the first embodiment.

FIG. 8 is a schematic diagram illustrating the operation of removing the needle-free binding section in the sheet processing apparatus according to the first embodiment.

As shown FIG. 8, the controller 400 repeatedly drives the pickup roller 334 to rotate in the reverse direction and the forward direction in ACT 40 to press the pickup roller 334 on the needle-free binding section 10 of the sheet bundle a plurality of times. As a result, if the needle-free binding section 10 is the crimping section 11 (refer to FIG. 5), the unevenness of the crimping section 11 is flattened and the frictional force among a plurality of the papers P in the crimping section 11 decreases. Thus, it is possible to weaken the bonding between the papers P in the needle-free binding section 10 and remove the needle-free binding section 10.

The controller 400 may change the position of the pickup roller 334 in the paper width direction at the time of executing the processing of removing the needle-free binding section 10 in ACT 40. For example, it is desirable that the controller 400 displaces the pickup roller 334 in the paper width direction so that the pickup roller 334 contacts the corner of the paper P. Thus, it is possible to press the pickup roller 334 against the needle-free binding section 10 if the needle-free binding section 10 is formed at the corner of the sheet bundle.

In the above-described embodiment, the sheet processing apparatus 1 includes the controller 400 controlling the paper conveyance mechanism 305 to remove the needle-free binding section 10 of the sheet bundle if the conveyance jam of the paper P occurs at the paper feed cassette 303 or the paper conveyance path 330. According to such a constitution, if the sheet bundle bound with the needle-free binding section 10 is accommodated in the paper feed cassette 303, the sheet bundle is conveyed and the conveyance jam of the paper P occurs, it is possible to remove the needle-free binding section 10, and to convey one paper P. Therefore, it is possible to eliminate the conveyance jam.

The controller 400 also performs control to rotate the pickup roller 334 alternately in both forward and reverse directions if the conveyance jam of the paper P occurs in the paper feed cassette 303 or the paper conveyance path 330. Thereby, the pickup roller 334 can be pressed on the needle-free binding section 10 of the sheet bundle a plurality of times. Thus, if the needle-free binding section 10 is the crimping section 11, it is possible to weaken the bonding between the papers P in the needle-free binding section 10 and remove the needle-free binding section 10. Therefore, it is possible to eliminate the conveyance jam.

Second Embodiment

In the first embodiment, the controller 400 alternately rotates the pickup roller 334 in both forward and reverse directions if the conveyance jam of the sheet (paper P) occurs. In contrast, in the second embodiment, the controller 400 make rotational speeds of the paper feed roller 132 and the separation roller 134 different if the conveyance jam of the sheet (original document G) occurs, which is different from the first embodiment.

The processing of removing the needle-free binding section 10 of the sheet bundle in the second embodiment is described in detail below. In the following description of the second embodiment, the processing of removing the needle-free binding section 10 of the sheet bundle in the image reading unit 100 is described as an example, but the same processing is applicable to the image forming unit 300.

In the present embodiment, the controller 400 performs control to rotate the paper feed roller 132 and the separation roller 134 by making the rotation speeds of the paper feed roller 132 and the separation roller 134 different if the conveyance jam of the original document G occurs at the document tray 120 or the document conveyance path 126. Specifically, the controller 400 executes the processing according to the following flow.

Figure 9:
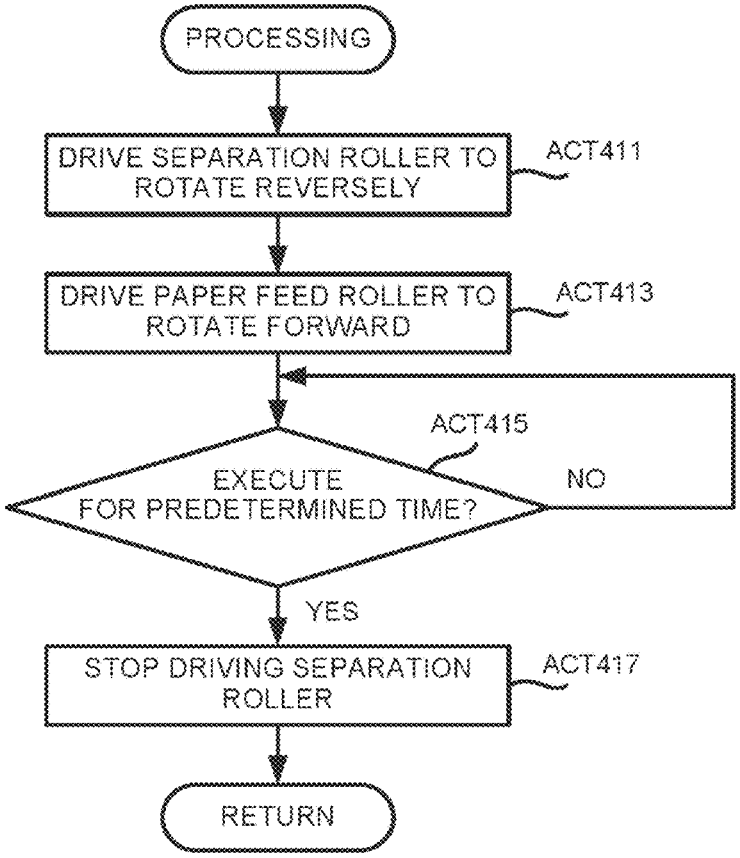
FIG. 9 is a flowchart illustrating the flow of a processing of removing a needle-free binding section in a sheet processing apparatus according to a second embodiment.

FIG. 9 is a flowchart illustrating the flow of the processing of removing the needle-free binding section in the sheet processing apparatus of the second embodiment.

As shown in FIG. 9, the controller 400 drives the separation roller 134 to rotate in the reverse direction (ACT 411). Subsequently, the controller 400 drives the paper feed roller 132 to rotate in the forward direction (ACT 413). An execution order of the processing in ACT 411 and the processing in ACT 413 is not particularly limited thereto and the processing in ACT 411 and the processing in ACT 413 may be executed at the same time. At this time, the controller 400 may increase the rotation speed of the paper feed roller 132 to be faster than that at the time of the normal conveyance of the original document G. The controller 400 may increase a rotational torque of the paper feed roller 132 to be greater than that at the time of the normal conveyance of the original document G.

Subsequently, the controller 400 determines whether or not the rotation driving of the separation roller 134 in the reverse direction and the rotation driving of the paper feed roller 132 in the forward direction are executed for a predetermined time (ACT 415). In other words, in ACT 415, the controller 400 determines whether or not the processing in ACT 411 and the processing in ACT 413 are executed for a predetermined time. If the rotation driving of the separation roller 134 in the reverse direction and the rotation driving of the paper feed roller 132 in the forward direction are not executed for a predetermined time (No in ACT 415), the controller 400 again executes the processing in ACT 415. If the rotation driving of the separation roller 134 in the reverse direction and the rotation driving of the paper feed roller 132 in the forward direction are executed for a predetermined time (Yes in ACT 415), the controller 400 stops driving the separation roller 134 to rotate reversely (ACT 417). Subsequently, the controller 400 conveys the original document G by the paper feed roller 132 and proceeds to the processing in ACT 50.

Figure 10:
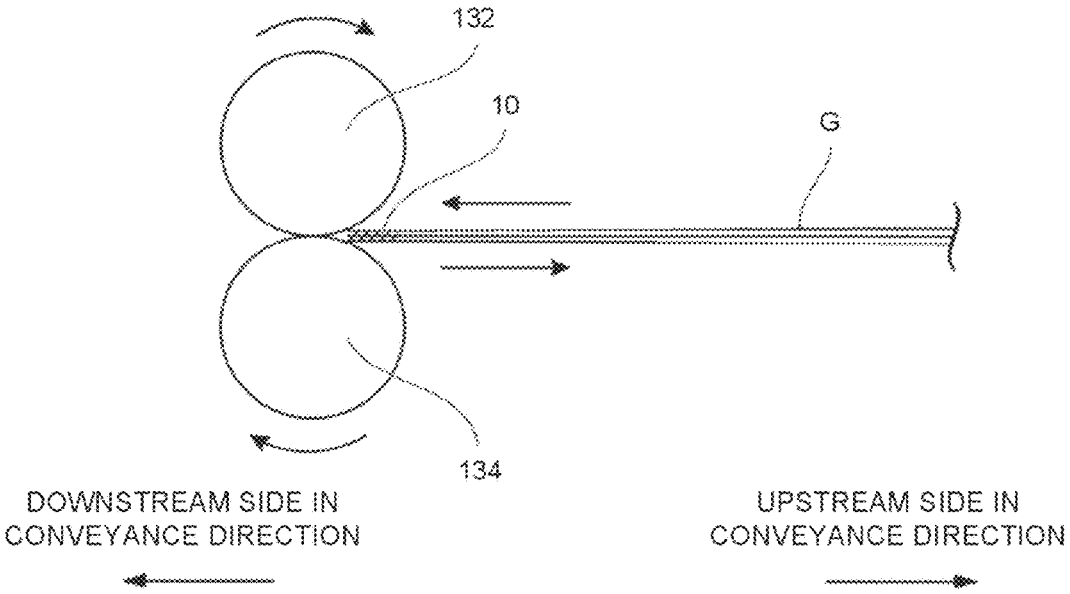
FIG. 10 is a schematic view illustrating the operation of removing the needle-free binding section in the sheet processing apparatus according to the second embodiment.

FIG. 10 is a schematic diagram illustrating the operation of removing the needle-free binding section in the sheet processing apparatus according to the second embodiment.

As shown in FIG. 10, the controller 400 enables the rotation speed of the separation roller 134 to be different from the rotation speed of the paper feed roller 132 by driving the separation roller 134 to rotate in a reverse direction in ACT 40. Thus, a vector of the force that the paper feed roller 132 applies to the original document G and a vector of force applied to the original document G by the separation roller 134 are different. Therefore, if the needle-free binding section 10 is a bonded place between the original documents G, it is possible to move the bonded original document G so that they are staggered and to peel off the bonding between the original documents G.

In the embodiment described above, the controller 400 makes the rotation speeds of the paper feed roller 132 and the separation roller 134 different if the conveyance jam of the original document G occurs at the document tray 120 or the document conveyance path 126. Thus, the original document G in contact with the paper feed roller 132 and the original document G in contact with the separation roller 134 can be moved to be staggered. Therefore, if the needle-free binding section 10 is a bonded place between the original documents G, it is possible to peel off the bonding between the original documents G. Therefore, it is possible to eliminate the conveyance jam.

In the present embodiment, the rotation speeds of the paper feed roller 132 and the separation roller 134 are differentiated by driving the separation roller 134 to rotate in the reverse direction, but the present invention is not limited thereto. For example, by driving the separation roller 134 to rotate in the forward direction at a slower speed than the paper feed roller 132, the rotation speeds of the paper feed roller 132 and the separation roller 134 may be different.

Third Embodiment

In the first embodiment, the controller 400 alternately rotates the pickup roller 334 in both forward and reverse directions if the conveyance jam of the sheet (paper P) occurs. In the third embodiment, on the other hand, the controller 400 rotates the pickup roller 334 in the forward direction in a state in which the movement of the sheet is regulated by a sheet pressing member 344 if the conveyance jam of the sheet (paper P) occurs, which is different from the first embodiment.

A processing for removing the needle-free binding section 10 of the sheet bundle in the third embodiment is described in detail below. In the following description of the third embodiment, the processing for removing the needle-free binding section 10 of the sheet bundle in the image forming unit 300 is described as an example, but the same processing is applicable to the image reading unit 100.

First, the structure of the image forming unit 300 of the present embodiment is described.

Figure 11:
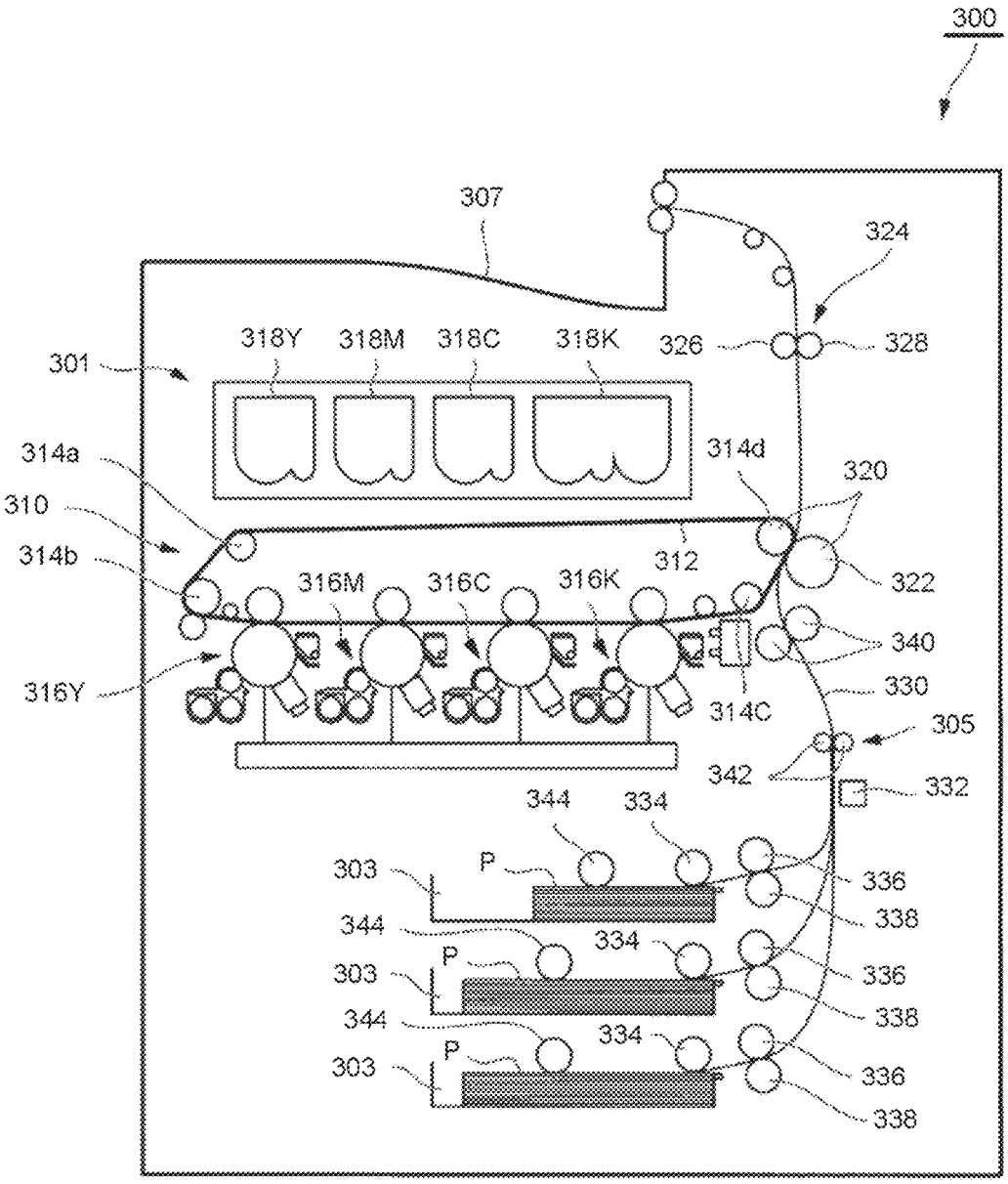
FIG. 11 is a schematically cross-sectional view exemplifying the structure of an image reading unit according to a third embodiment.

FIG. 11 is a schematically cross-sectional view exemplifying the structure of the image reading unit of the third embodiment.

As shown in FIG. 11, the image forming unit 300 of the present embodiment has a structure the same as that of the image forming unit 300 according to the first embodiment except that it includes the sheet pressing member 344. The sheet pressing member 344 is provided at the upstream side in the conveyance direction of the paper feed roller 336. The sheet pressing member 344 is provided above the paper conveyance path 330 to be capable of approaching and retreating from the paper conveyance path 330. The sheet pressing member 344 approaches the paper conveyance path 330 and then abuts against the paper P to regulate the conveyance of the paper P. At this time, the sheet pressing member 344 abuts against the paper P at a position where an end at the downstream side in the conveyance direction thereof abuts against the paper feed roller 336. In the present embodiment, the sheet pressing member 344 is a driving roller connected to the driving section such as the motor or the like. A rotation axis of the sheet pressing member 344 is parallel to that of the paper feed roller 336. The sheet pressing member 344 conveys the paper P towards the upstream side in the conveyance direction by forward rotation while abutting against the paper P.

In the present embodiment, if the conveyance jam of the paper P occurs at the paper feed cassette 303 or the paper conveyance path 330, the controller 400 controls the sheet pressing member 344 so that the sheet pressing member 344 regulates the conveyance of the paper P and performs control to rotate the paper feed roller 336 in the forward direction. Specifically, the controller 400 executes the processing according to the following flow.

Figure 12:
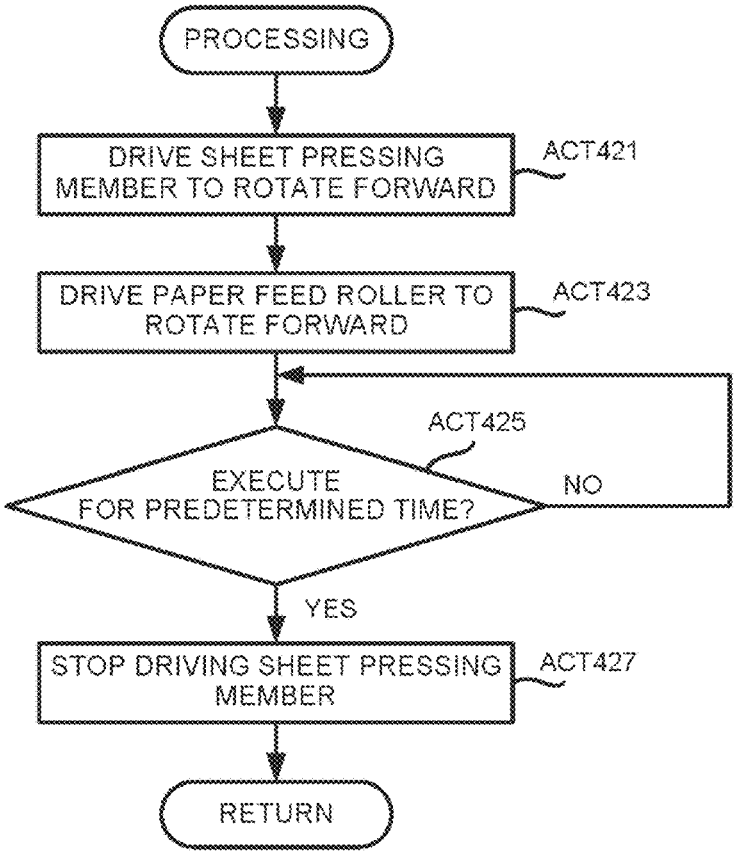
FIG. 12 is a flowchart illustrating the flow of a processing of removing a needle-free binding section in a sheet processing apparatus according to the third embodiment.

FIG. 12 is a flowchart illustrating the flow of the processing of removing the needle-free binding section in the sheet processing apparatus according to the third embodiment.

As shown in FIG. 12, the controller 400 enables the sheet pressing member 344 to approach the paper conveyance path 330 and drives the sheet pressing member 344 to rotate in the forward direction (ACT 421). Subsequently, the controller 400 drives the paper feed roller 336 to rotate in the forward direction (ACT 423). The conveyance direction of the paper P by the sheet pressing member 344 is opposite to the conveyance direction of the paper P by the paper feed roller 336. Thus, the sheet pressing member 344 regulates the conveyance of the paper P to the downstream side in the conveyance direction without conveying the paper P towards the upstream side in the conveyance direction. The execution order of the processing in ACT 421 and the processing in ACT 423 is not particularly limited, and the processing in ACT 421 and the processing in ACT 423 may be executed at the same time.

Subsequently, the controller 400 determines whether or not the rotation driving of the sheet pressing member 344 in the forward direction and the rotation driving of the paper feed roller 336 in the forward direction are executed for a predetermined time (ACT 425). In other words, in ACT 425, the controller 400 determines whether or not the processing in ACT 421 and the processing in ACT 423 are executed for a predetermined time. If the rotation driving of the sheet pressing member 344 in the forward direction and the rotation driving of the paper feed roller 336 in the forward direction are not executed for a predetermined time (No in ACT 425), the controller 400 again executes the processing in ACT 425. If the rotation driving of the sheet pressing member 344 in the forward direction and the rotation driving of the paper feed roller 336 in the forward direction are executed for a predetermined time (Yes in ACT 425), the controller 400 stops driving the sheet pressing member 344 to rotate forward (ACT 427). Subsequently, the controller 400 conveys the paper P via the paper feed roller 336 and proceeds to the processing in ACT 50.

Figure 13:
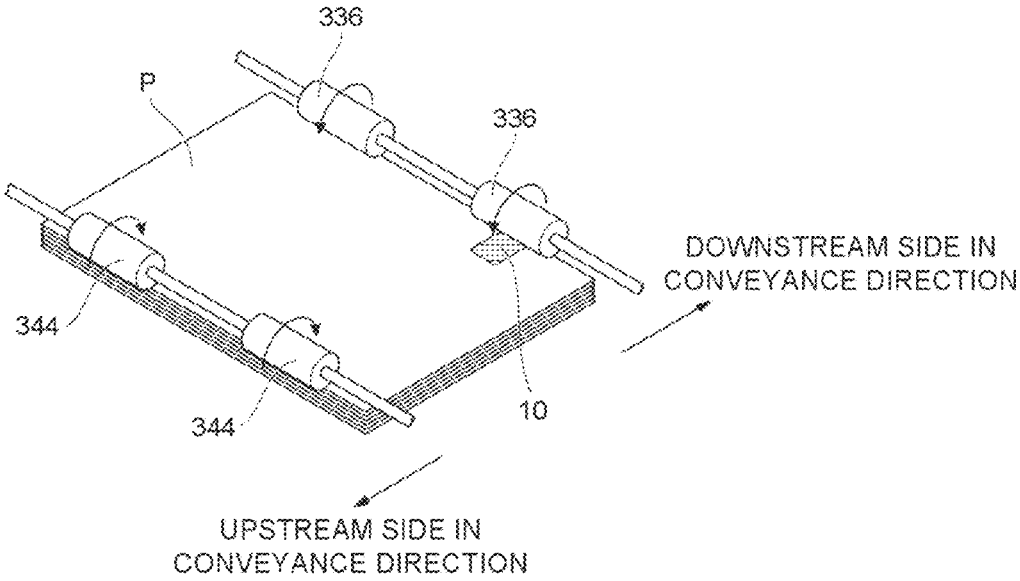
FIG. 13 is a schematic diagram illustrating the operation of removing the needle-free binding section in the sheet processing apparatus according to the third embodiment.

FIG. 13 is a schematic diagram illustrating the operation of removing the needle-free binding section in the sheet processing apparatus according to the third embodiment.

In the above-described embodiment, as shown in FIG. 13, the controller 400 regulates the conveyance of the paper P to the downstream side in the conveyance direction by the sheet pressing member 344 in ACT 40, and drives the paper feed roller 336 to rotate in the forward direction. As a result, the paper feed roller 336 rubs the end at the downstream side in the conveyance direction of the paper P toward the downstream side in the conveyance direction. Therefore, if tape is affixed as the needle-free binding section 10 to the end at the downstream side in the conveyance direction of the paper P, the tape can be peeled off. Therefore, it is possible to eliminate the conveyance jam.

In the present embodiment, the sheet pressing member 344 is a driving roller, but the present invention is not limited thereto. The sheet pressing member may be a pad that contacts the sheet and regulates the sheet conveyance by frictional force as long as it can contact the sheet to regulate the conveyance of the sheet. The pickup roller 334 may be used instead of the sheet pressing member 344.

Fourth Embodiment

In each of the above embodiments, if the conveyance jam of the sheet occurs at any one of the document tray 120, the paper feed cassette 303, the document conveyance path 126, or the paper conveyance path 330 (Yes in ACT 20), a processing of removing the needle-free binding section 10 of the sheet bundle in ACT 40 is executed. On the other hand, in the fourth embodiment, in the case in which the conveyance jam of the sheet occurs in the conveyance paths 126 and 330 of the sheet (Yes in ACT 20), the type of the conveyance jam is determined, which is different from the above embodiments.

Figure 14:
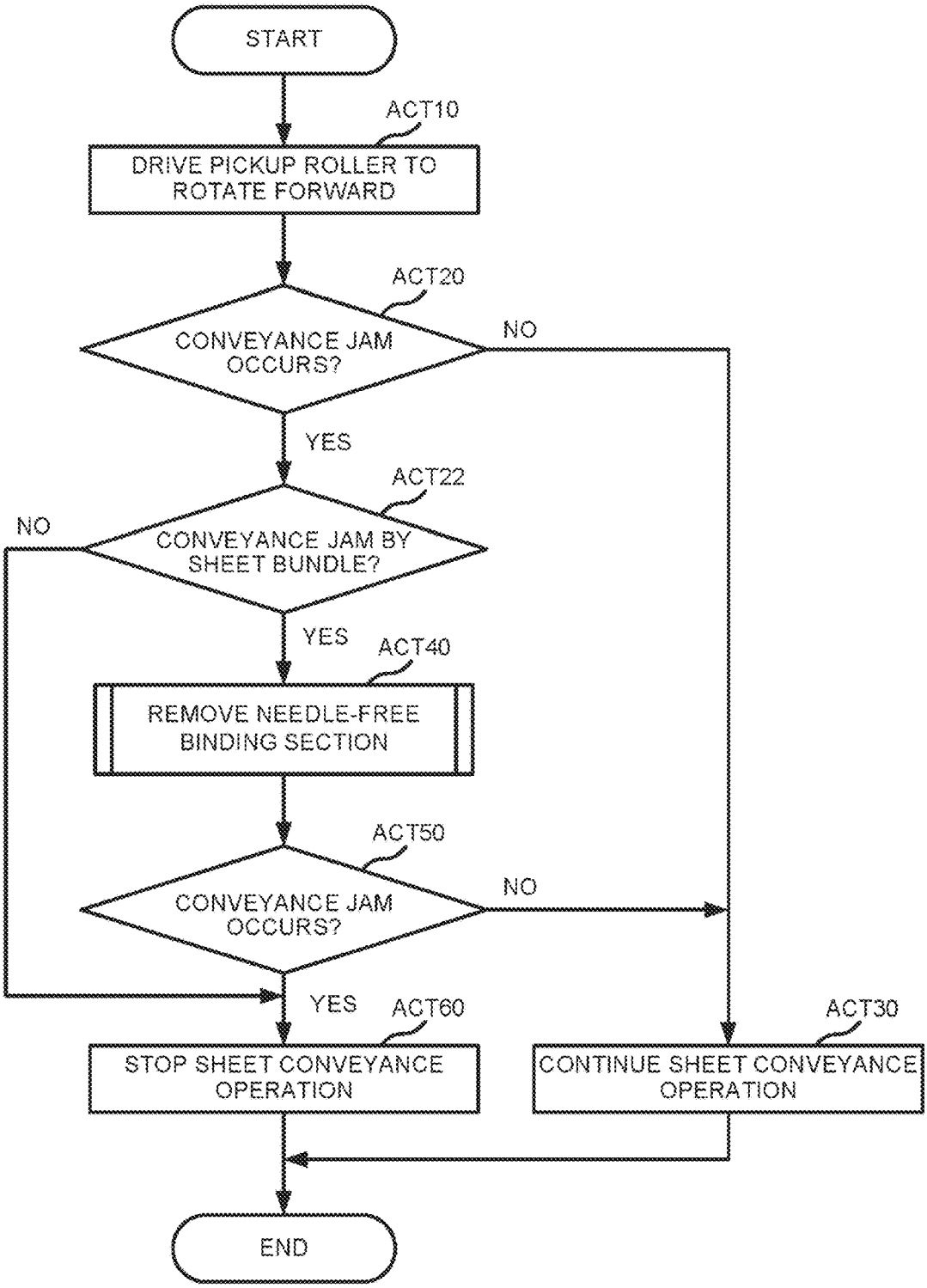
FIG. 14 is a flowchart exemplifying the operation of a sheet processing apparatus according to a fourth embodiment.

FIG. 14 is a flowchart exemplifying the operation of the sheet processing apparatus according to the fourth embodiment.

The sheet processing apparatus 1 carries out the processing according to the flow shown in FIG. 14 to convey the sheet. If the conveyance jam occurs (Yes in ACT 20), the controller 400 determines whether or not the type of the conveyance jam is the conveyance jam associated with conveyance of the sheet bundle (ACT 22). For determination of the type of the conveyance jam, a well-known technology (for example, Japanese Unexamined Patent Publication No. 2013-1573) can be used. For example, if the conveyance jam accompanying the conveyance of the sheet bundle occurs, the sheet at the top of the sheet bundle is pulled by a roller, and thus, the edge of the sheet bundle is lifted. For this reason, if the conveyance jam occurs, whether the type of the conveyance jam is the conveyance jam accompanying conveyance of the sheet bundle can be determined by detecting presence or absence of the lifting of the edge of the sheet bundle. If the type of the conveyance jam is the conveyance jam associated with the conveyance of the sheet bundle (Yes in ACT 22), the controller 400 proceeds to the processing in ACT 40. If the type of the conveyance jam is not the conveyance jam associated with the conveyance of the sheet bundle (No in ACT 22), the controller 400 proceeds to the processing in ACT 60.

In the above-described embodiment, the sheet processing apparatus 1 determines whether or not the type of the conveyance jam is the conveyance jam associated with the conveyance of the sheet bundle if the conveyance jam occurs in any one of the document tray 120, the paper feed cassette 303, the document conveyance path 126, or the paper conveyance path 330. Therefore, it is possible to execute the processing of removing the needle-free binding section 10 only if the conveyance jam accompanying conveyance of the sheet bundle occurs, and it is possible to improve the efficiency of sheet conveyance operation.

In each of the above embodiments, the case in which the sheet processing apparatus 1 is an MFP is described as an example. However, the present invention is not limited thereto, and the sheet processing apparatus may be, for example, a printer, a copying machine, or the like.

According to at least one embodiment described above, the sheet processing apparatus has the controller for controlling the conveyance mechanism so as to remove the needle-free binding section of the sheet bundle if the conveyance jam of the sheet occurs in the conveyance path. According to such a structure, if the sheet bundle stapled in the needle-free binding section is conveyed and the conveyance jam of the sheet occurs, the needle-free binding section is removed and the conveyance jam is eliminated, and thus, it is possible to convey one sheet. Therefore, it is possible to eliminate the conveyance jam.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A sheet processing apparatus, comprising:

a housing section configured to accommodate a sheet;

a conveyance mechanism configured to convey the sheet accommodated in the housing section to a predetermined position at a downstream side of a sheet conveyance path in a sheet conveyance direction; and a controller configured to control the conveyance mechanism to eliminate a conveyance jam of the sheet if a conveyance jam of the sheet is determined to be due to a sheet bundle having a needle-free binding section, wherein the conveyance mechanism comprises a first roller configured to abut against the sheet accommodated in the housing section to feed sheets one by one from the housing section, and the controller is configured to perform control to rotate the first roller alternately in forward and reverse directions if a conveyance jam of the sheet occurs.

2. The sheet processing apparatus according to claim 1, wherein the controller is configured to:

determine if the conveyance jam of the sheet is associated with conveyance of a sheet bundle, and stop sheet conveyance without removing the needle-free binding section if it is determined that the conveyance jam is not associated with conveyance of a sheet bundle.

3. A sheet processing apparatus, comprising:

a housing section configured to accommodate a sheet;

a conveyance mechanism configured to convey the sheet accommodated in the housing section to a predetermined position at a downstream side of a sheet conveyance path in a sheet conveyance direction; and a controller configured to control the conveyance mechanist to eliminate a conveyance jam of the sheet if a conveyance jam of the sheet is determined to be due to a sheet bundle having a needle-free binding section, wherein the conveyance mechanism comprises a second roller configured to convey the sheet accommodated in the housing section towards the downstream side in a sheet conveyance direction, and a third roller arranged opposite to the second roller and forming a nip for sandwiching the sheet, and the controller is configured to perform control to rotate the second roller and the third roller by enabling rotation speeds of the second roller and the third roller to be different from each other if the conveyance jam of the sheet occurs.

4. The sheet processing apparatus according to claim 3, wherein the controller is configured to:

determine if the conveyance jam of the sheet is associated with conveyance of a sheet bundle, and stop sheet conveyance without removing the needle-free binding section if it is determined that the conveyance jam is not associated with conveyance of a sheet bundle.

5. A sheet processing apparatus, comprising:

a housing section configured to accommodate a sheet;

a conveyance mechanism configured to convey the sheet accommodated in the housing section to a predetermined position at a downstream side of a sheet conveyance path in a sheet conveyance direction;

a controller configured to control the conveyance mechanism to eliminate a conveyance jam of the sheet if a conveyance jam of the sheet is determined to be due to a sheet bundle having a needle-free binding section; and a regulating member configured to abut against the sheet to regulate conveyance of the sheet, wherein the conveyance mechanism comprises a fourth roller configured to convey the sheet towards the downstream side in the sheet conveyance direction, the regulating member is disposed at an upstream side in the sheet conveyance direction of the fourth roller and abuts against the sheet located at a position where an end of the sheet at the downstream side in the sheet conveyance direction contacts with the fourth roller, and the controller is configured to control the regulating member to regulate conveyance of the sheet by the regulating member if the conveyance jam of the sheet occurs and performs control to rotate the fourth roller.

6. The sheet processing apparatus according to claim 5, wherein the controller is configured to:

determine if the conveyance jam of the sheet is associated with conveyance of a sheet bundle, and stop sheet conveyance without removing the needle-free binding section if it is determined that the conveyance jam is not associated with conveyance of a sheet bundle.

* * * * *